US005508791A

United States Patent [19]

Besshi et al.

[11] Patent Number: 5,508,791

[45] Date of Patent: Apr. 16, 1996

[54] POWER TRANSMISSION MECHANISM OPTIMUM FOR OPTICAL SYSTEM OF IMAGE FORMING APPARATUS

[75] Inventors: Takao Besshi; Shuji Fujisawa, both of Osaka, Japan

[73] Assignee: Mita Industrial Co., Ltd., Osaka, Japan

[21] Appl. No.: 165,159

[22] Filed: Dec. 10, 1993

[30] Foreign Application Priority Data

Dec. 25, 1992 [JP] Japan ..... 4-346220
Dec. 28, 1992 [JP] Japan ..... 4-349144

[51] Int. Cl.[6] ..... G03G 15/28

[52] U.S. Cl. ..... 355/235; 355/58; 355/243

[58] Field of Search ..... 355/232, 233, 355/234, 235, 236, 237, 238, 240, 242, 243, 57, 55, 58

[56] References Cited

U.S. PATENT DOCUMENTS

| | | | |
|---|---|---|---|
| 4,295,736 | 10/1981 | Ikeda | 355/57 |
| 4,368,976 | 1/1983 | Shogren | 355/235 X |
| 4,453,824 | 6/1984 | Miyake et al. | 355/243 X |
| 4,505,579 | 3/1985 | Furuichi | 355/55 |
| 4,519,694 | 5/1985 | Kashiwagi et al. | 355/243 X |
| 4,572,658 | 2/1986 | Suzuki et al. | 355/57 |
| 4,740,815 | 4/1988 | Tsuruoka | 355/233 |
| 4,965,638 | 10/1990 | Hediger | 355/235 |
| 5,072,255 | 12/1991 | Kono | 355/235 X |
| 5,113,225 | 5/1992 | Deguchi | 355/235 |
| 5,355,198 | 10/1994 | Saito | 355/243 |

*Primary Examiner*—A. T. Grimley
*Assistant Examiner*—Shuk Y. Lee
*Attorney, Agent, or Firm*—Beveridge, DeGrandi, Weilacher & Young

[57] ABSTRACT

The invention relates to a power transmission mechanism included in the optical system of an image forming apparatus. A power transmission mechanism according to a first mode composes a link mechanism for interlocking the moving member for adjusting the optical path length, in response to the displacement of a lens unit, when changing the magnification factor of the original image. This link mechanism comprises an output unit integrally composed on the lens unit, and a cam member for converting the moving extent of the lens unit by a lever ratio of two cams and transmitting to the moving member. On the other hand, a power transmission mechanism according to a second mode of the invention includes torque transmission mechanism for transmitting a torque alternatively to a scanning mechanism and a magnification varying mechanism. The torque transmission mechanism includes elastic linings to be pressed alternatively to the input members of the scanning mechanism and magnification varying mechanism.

27 Claims, 7 Drawing Sheets

POWER TRANSMISSION MECHANISM OPTIMUM FOR OPTICAL SYSTEM OF IMAGE FORMING APPARATUS

CROSS REFERENCE TO RELATED APPLICATION

This application claims the priority benefits under 35 USC §119 of Japanese Patent Application Serial No. 346220/1992 filed on Dec. 25, 1992, and the Japanese Patent Application Serial No. 349144/1992 filed on Dec. 28, 1992, the disclosures of which are incorporated herein by references.

BACKGROUND OF THE INVENTION

1. Field of the Invention

The invention relates to a power transmission mechanism for optical system of image forming apparatus, and more particularly to a power transmission mechanism for creating images by varying a magnification factor of an original image.

2. Description of the Related Art

In this kind of optical system, generally, as a moving frame for illuminating and scanning the original, a first moving frame possessing a first mirror for guiding the fluorescent lamp for illuminating the original or the reflected light from the original to a specified optical path, and a second moving frame fixing second and third mirrors are disposed so as to be movable reciprocally in a state parallel to the original. By setting the moving speed of the first moving frame at a specific rate (½ speed in the case of equal magnification) to the moving speed of the second moving frame, the original is illuminated and scanned (see, for example, the unexamined Japanese Patent Publication No. 315775/1989).

On the other hand, in the optical path from the third mirror of the second moving frame to a fourth mirror fixed on a third moving frame for adjusting the length of optical path, lenses of a lens unit are disposed. The lens unit is composed so as to be free to displace relatively, in the state along the optical path, with respect to the second moving frame, and by setting the optical length from the lens to the image creating area at a specific rate (½ in the case of equal magnification), for the optical path length from the original to the lens, the original image can be focused on the image creating area at a desired magnification factor.

To displace the lens unit relatively, a driving wire is fixed in the lens unit, and it is constituted to drive this driving wire in a specified direction by an optical system motor. On the other hand, the lens unit and the third moving frame are coupled through a link mechanism, and by interlocking the third moving frame in response to the displacement of the lens unit, the optical length from the lens to the image creating area was adjusted.

Specifically, the driving wire for driving the lens unit was wound around a cam pulley, and a part was fixed on the third moving frame. The cam pulley was eccentric to the center of outer circumference of winding the driving wire in the center of rotation, in order to displace the third moving frame to the corresponding position along the displacement of the lens unit.

To distribute the image forming apparatus comprising such optical system widely for household and personal use, it is desired to reduce the size and weight as much as possible. In the link mechanism of such conventional optical system, since the center of rotation is the cam pulley eccentric to the center of the outer circumference of winding the driving wire, it is necessary to set the outer diameter and the eccentricity of the cam pulley considerably larger, and the lens unit itself becomes larger in size, the reduction of size and weight of the apparatus cannot be achieved. In particular, to set the variable range of magnification factor wider, the interlocking range of the third moving frame must be set larger, which adds to the inclination of increase in size. This fact substantially limited the range of enlarging value and reducing value of the original image in the conventional image forming apparatus developed for household and personal use.

In the light of such inconvenience, there arises a true necessity of power transmission mechanism of optical system capable of setting wider the range of enlarging value and reducing value of the original image of the image forming apparatus developed for household and personal use, not alone downsizing the lens unit itself and achieving the reduction of size and weight of the entire apparatus.

To illuminate and scan the original, the first and second moving frames were coupled to a reciprocal drive mechanism for transmitting a torque from a torque source of the optical system drive unit.

On the other hand, to vary the magnification of the original image, the lens unit was coupled to a magnification varying drive mechanism. The magnification varying drive mechanism partly received the torque from the torque source of the optical system drive unit through constituent parts of the reciprocal drive mechanism. Accordingly, in the magnification varying action of the lens unit, when the torque is transmitted from the torque source of the optical system drive unit to the magnification varying drive mechanism, the first and second moving frames follow the lens unit, and move from the home position.

Besides, transmission of torque to each drive mechanism was effected through gear engagement. In the conventional constitution, hence, it was necessary to control positioning of the output member of the torque source and the input member of the drive mechanism in the rotating direction.

In the torque transmission mechanism of the conventional optical system, in this way, in the magnification varying action of the lens unit, it was constituted so that the first and second moving frames would follow the lens unit and move from the home position, and therefore when illuminating and scanning the original after varying the magnification factor of the original image, it was necessary to return each movable frame to the home position, and the control was complicated. In the conventional constitution, furthermore, it was necessary to control the positioning between the output member of the torque source and the input member of the drive mechanism in the rotating direction, which further complicated the control.

In the constitution in which the first and second moving frames follow the lens unit, the load acting on the torque source of the optical drive unit increases, and the entire apparatus becomes not only larger in size, but also higher on cost.

Therefore, in the light of such problems, it gives rise to the necessity of power transmission mechanism of optical system which can be simplified in control, and is inexpensive and lightweight.

SUMMARY OF THE INVENTION

The invention relates to a power transmission mechanism optimum for optical system of image forming apparatus fulfilling the necessity mentioned above. The power transmission mechanism in a first mode of the invention presents a link mechanism for adjusting the optical path length in response to the displacement of the lens unit. This link mechanism possesses a novel cam constitution which is driven along a cam surface, by which a long interlock distance can be taken. Accordingly, in the first mode of the invention, the sinking extent of the cam surface can be set small, and the lens unit itself may be reduced in size. Downsizing of the lens unit contributes not only to downsizing of the entire apparatus, but also to expansion of the range of enlarging value and reducing value of the original image.

The power transmission mechanism in a second mode of the invention presents a novel torque transmission mechanism. The torque transmission mechanism comprises output means for alternatively pressing two input members, so that a single torque source can alternatively drive the reciprocal drive mechanism and magnification varying drive mechanism of the optical system. Accordingly, in the power transmission mechanism in the second mode, it is not necessary to return the moving frame for illumination and scanning to the home position after varying the magnification factor of the original image, so that the control is simplified. Still more, since either one of the reciprocal drive mechanism and the magnification varying drive mechanism is driven, the load acting on the reciprocal drive source is smaller. Hence, by using a torque source of a relatively small size, the entire apparatus can be reduced in size, and the cost is also lowered. Furthermore, the power transmission mechanism in the second mode of the invention can transmit the torque regardless of the relative positions of the input member and output member in the circumferential direction. Therefore, positioning at the time of connection is not needed, and the constitution is simplified.

These and other objects, features and effects of the invention will be better appreciated and understood in the following detailed description of the embodiments taken in conjunction with the accompanying drawings.

DESCRIPTION OF THE PREFERRED EMBODIMENTS

Figure 1:
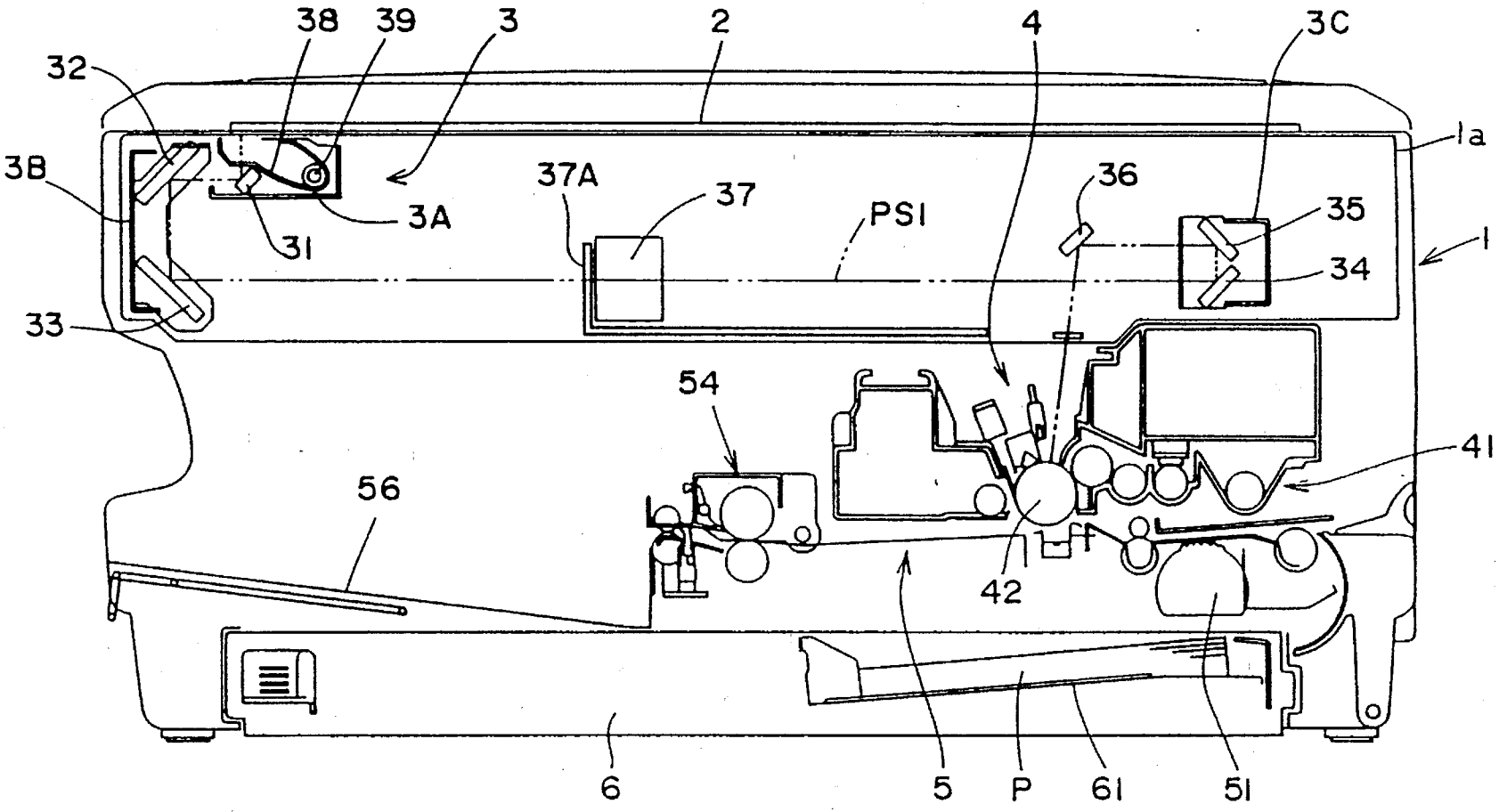
FIG. 1 is a schematic diagram showing the internal structure of a copier as an image forming apparatus employing an embodiment of the invention.

Referring first to FIG. 1, the copier of the embodiment comprises, inside a copier main body 1, an optical system 3 for illuminating and scanning the original placed on an original platen 2 for leading the reflected light from the original to a photosensitive drum 42, an image creating part 4, including the photosensitive drum, for making the electrostatic latent image formed on the photosensitive drum 42 by a developing device 41,and transferring on a paper, and a paper conveying part 5 for drawing out the paper from a paper feed tray 61 in a paper compartment 6 by a paper feed roll 51 in a semicircular section, and discharging into a discharge tray 56 of the copier main body 1 through the image creating part 4.

The optical system 3 comprises an optical frame 1*a* for holding various functional parts. In this optical frame 1*a*, as the moving frame for illuminating and scanning the original, a first moving frame 3A possessing a first mirror 31 for guiding a fluorescent lamp 39 possessing a reflection mirror 38 or the reflected light from the original into a specific optical path, and a second moving frame 3B fixing second and third mirrors 32 and 33 are disposed so as to be movable reciprocally in a state parallel to the original. Furthermore, the optical frame la incorporates a lens unit 37A including a lens 37 for focusing the light from the third mirror 33, a third moving frame 3C for supporting a fourth mirror 34 and a fifth mirror 35 for reflecting the light from the lens unit 37A, and a sixth mirror 36 for leading the light from the fifth mirror into the photosensitive drum 42. The original is illuminated by the fluorescent lamp 39 provided with a reflector 38, being fixed to the first moving frame 3A, and the reflected light from the original is guided to the photosensitive drum 42 sequentially by way of the first mirror 31 fixed on the first moving frame 3A, the second mirror 32 and third mirror 33 fixed on the second moving frame 3B, the lens 37, the fourth mirror 34 and fifth mirror 35 fixed on the third moving frame 3C, and the sixth mirror 36 fixed on the copier main body 1. The moving speed of the first moving frame 3A is set at a specific rate (½ in the case of equal magnification) to the moving speed of the second moving frame 2B. The lens 37 is constituted so as to be free to displace along the optical path PS1 through the lens unit 37A.

Figure 2:
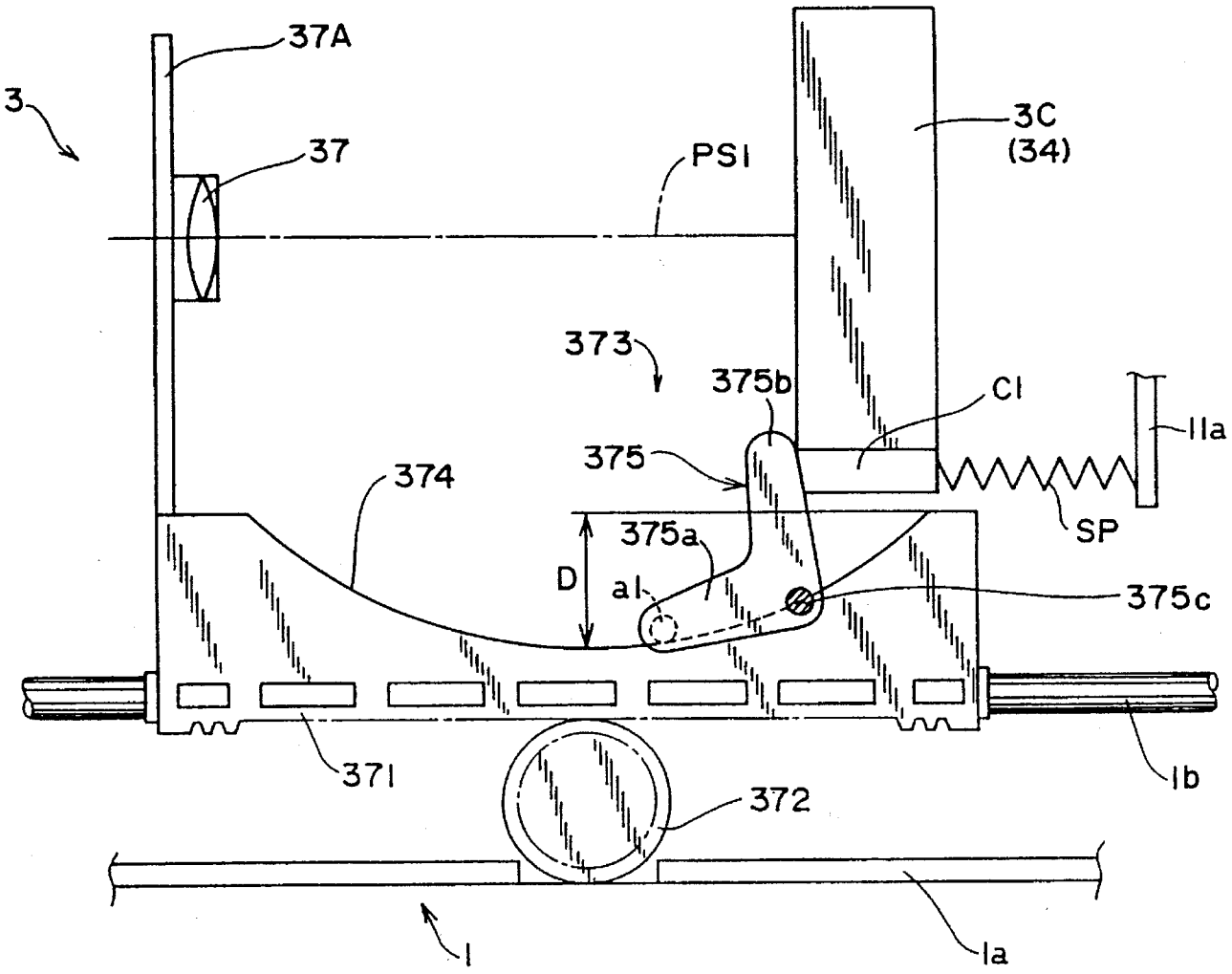
FIG. 2 is a bottom outline showing essential parts of the embodiment in equal magnification.
Figure 3:
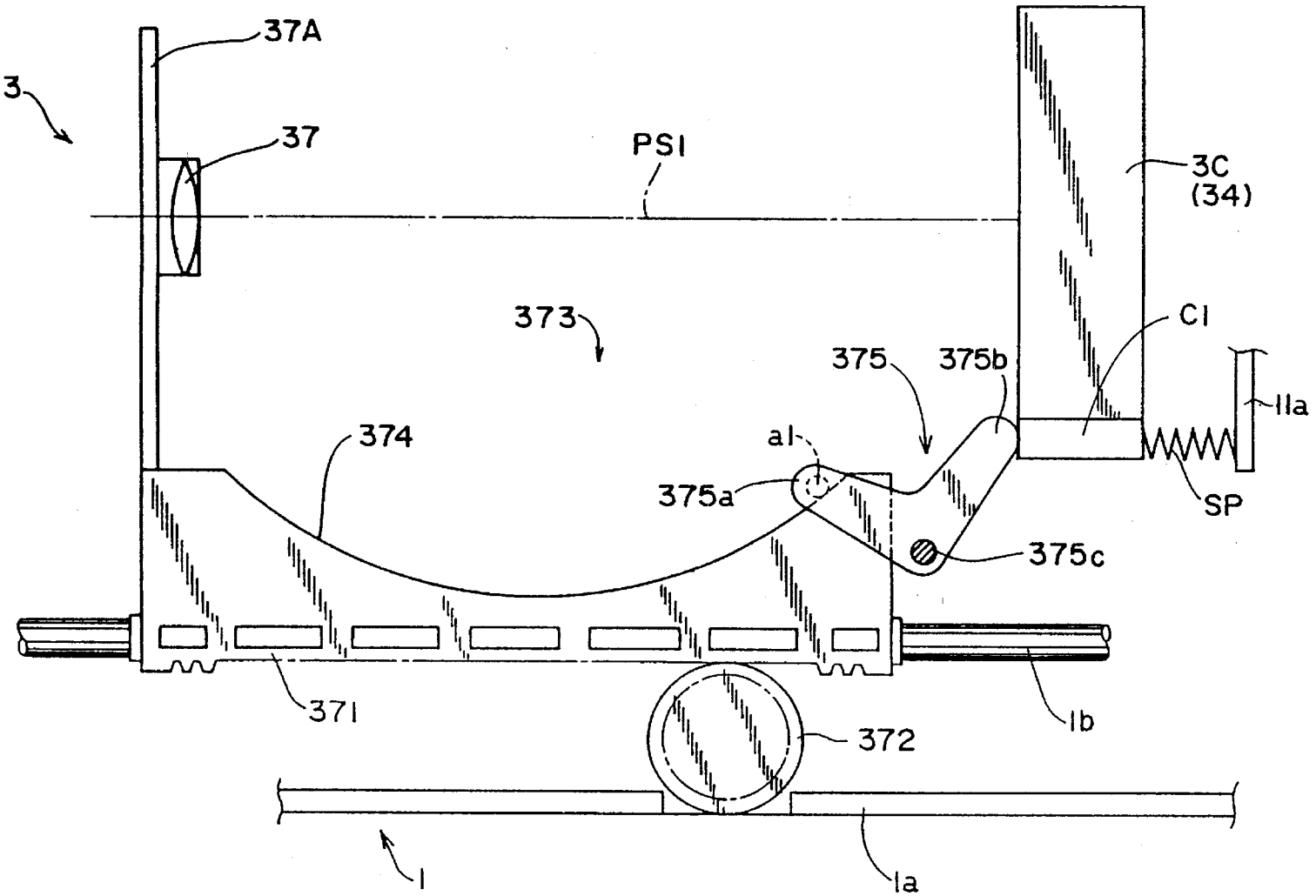
FIG. 3 is a bottom outline showing essential parts of the embodiment in magnification.

Describing more specifically by referring to FIG. 2 and FIG. 3, the lens unit 37A is provided with a rack gear 371 made of resin extended along the optical path PS1 reaching from the third mirror 33 to the fourth mirror 34. The rack gear 371 is slidably supported by an optical bar 1*b* fixed on the optical frame 1*a* of the copier main body 1. By rotating and driving a pinion gear 372 which is engaged with this rack gear 371 in a specific direction when changing the magnification factor of the original image, the lens unit 37A is moved relatively with respect to the second moving frame 3B. As the means for rotating and driving the pinion gear 372 in the specific direction, a torque transmission mechanism M is employed, which is described in detail in FIG. 4.

On the other hand, the lens unit 37A and third moving frame 3C are coupled together through a first power transmission mechanism, that is, a link mechanism 373, and by interlocking the third moving frame 3C corresponding to the displacement of the lens unit 37A, it is constituted so that the optical path length from the lens 37 to the image creating part 4 (see FIG. 1) may be adjustable. In other words, the third moving frame 3C is composed as a moving frame for adjustment of optical path length by the link mechanism 373.

The link mechanism 373 is integrally formed on the back side of the rack gear 371 of the lens unit 37A, and comprises a cam surface 374 sinking smoothly in the orthogonal direction approximately to the displacement direction (the lateral direction in FIG. 2 and FIG. 3) of the lens unit 37A, and a cam member 375 for link for displacing the third moving frame 3C along the optical path PS1 in response to the move of the lens unit 37A.

The cam member 375 for link is a resin molding with an approximately L-shape in a plan view integrally provided with a first cam arm 375*a* and a second cam arm 375*b*. The first cam arm 375*a* is always engaged slidably with the cam surface 374 through a protrusion al provided at the front end in the longitudinal direction. From the base end in the longitudinal direction of the first cam arm 375*a*, the second cam arm 375*b* is extended. The second cam arm 375*b* is extended in the direction approximately orthogonal to the first cam arm 375*a*, and the front end in the longitudinal direction is engaged with an input member C1 of the third moving frame 3C. This input member C1 is a member in a projecting form drooping integrally from the lower surface of the third moving frame 3C, and the surface of the opposite side engaged with the second cam arm 375*b* is biased by a compression coil spring SP fixed on a standing piece 11*a* planted on the optical frame 1*a* of the copier main body 1 at one end.

The cam member 375 for link is further formed integrally with a fulcrum member 375*c*. The fulcrum member 375*c* is provided in the approximately intersecting part of the both cam arms 375*a* and 375*b*, and pivots the both cam arms 375*a* and 375*b*, as being rotatably supported on the bottom plate of the optical frame 1*a*.

According to the link mechanism 373, when changing the magnification factor of the original image, for example, if the lens unit 37A is displaced from the position shown in FIG. 2 to the image enlarging position shown in FIG. 3 along the optical path PS1, the cam surface 37A is displaced together to the left side in the drawing, and the first cam arm 375*a* is turned clockwise in FIG. 2 and FIG. 3, about the fulcrum member 375*c* by the cam surface 374. As a result, the second cam arm 375*b* turns together with the first cam arm 375*a*, resisting the popping force of the compression spring SP to feed driving force to the third moving frame 3C, so that the cam member 375 for link can displace the third moving frame 3C to the right side of the drawing along the optical path PS1, in response to the move of the lens unit 37A.

In the link mechanism 373 of the optical system in the embodiment, the second cam arm 375*b* is extended in the direction approximately orthogonal to the first cam arm 375*a* from the base end in the longitudinal direction of the first cam arm 375*a*, and the fulcrum member 375*c* is disposed nearly at the intersection of the both cam arms 375*a* and 375*b*, and therefore a long interlocking distance can be taken in the direction of the optical path PS1, by the lever ratio (approximately 1:1 in this embodiment) of the first cam arm 375*a* and the second cam arm 375*b*, so that the sinking extent D (35 mm in the embodiment) of the cam surface 374 may be set small.

Thus, according to the link mechanism 373 of the optical system of the embodiment, by taking a long interlocking distance in the direction of optical path PS1 by the lever ratio of the first cam arm 375*a* and second cam arm 375*b*, the cam surface 374 of a relatively small sinking extent D can be employed, and the lens unit 37A can be reduced in size, and the entire apparatus can be reduced in size and weight, and the range of enlarging value and reducing value of the original image in the image forming apparatus developed for household and personal use can be set wider, among other outstanding effects.

Referring now to FIG. 4 through FIG. 7, a second power transmission mechanism of the embodiment, that is, a torque transmission mechanism M comprises a gear cover M1 fixed on the optical frame 1*a*. The gear cover M1 integrally comprises a back plate M11 confronting a specific position of the optical frame 1*a*, a pair of side plates M12 extending forward (the direction of the optical frame 1*a* side) from both sides of the back plate 11, and flanges M13 extending from the both side plates M12, so as to be detachably fixed on the optical frame 1*a* by fastening the flanges M13 with bolts M2.

On the back plate M11 of the gear cover M1, the motor M3 is disposed as the torque source. The rotary shaft M31 of the motor M projects inside of the gear cover M1 from the back side of the back plate M11, and at the front end thereof, a power transmission gear M4 is fixed.

In the power transmission gear M4, an output gear M5 is engaged as an output member for delivering the torque from the motor M3. The output gear M5 is fixed nearly in the middle of a sliding shaft M6 parallel to the rotary shaft M31 of the motor M3. The sliding shaft M6 projects to the optical frame 1*a* side at one end, and the other end is exposed to the back side of the back plate M11 projecting to the back plate M11 side of the gear cover M1.

Between the output gear M5 and the optical frame 1*a* is disposed a scanning side input gear M7 as a scanning side input member for transmitting the torque to a scanning mechanism L1 coupled to the first and second moving frames 3A and 3B. The scanning side input gear M7 integrally comprises an annular boss part M71 penetrating almost concentrically at one end side of the sliding shaft M6 in assembling, and is rotatably supported on the optical frame la in the state of penetrating through the side plate of the optical frame la, by way of a bearing M72. On the surface confronting the output gear M5 of the scanning side input gear M7, a urethane-made elastic lining MR1 is glued. The elastic lining MR1 is to transmit the torque from the output gear M5 to the scanning side input gear M7, when illuminating and scanning the original.

Figure 6:
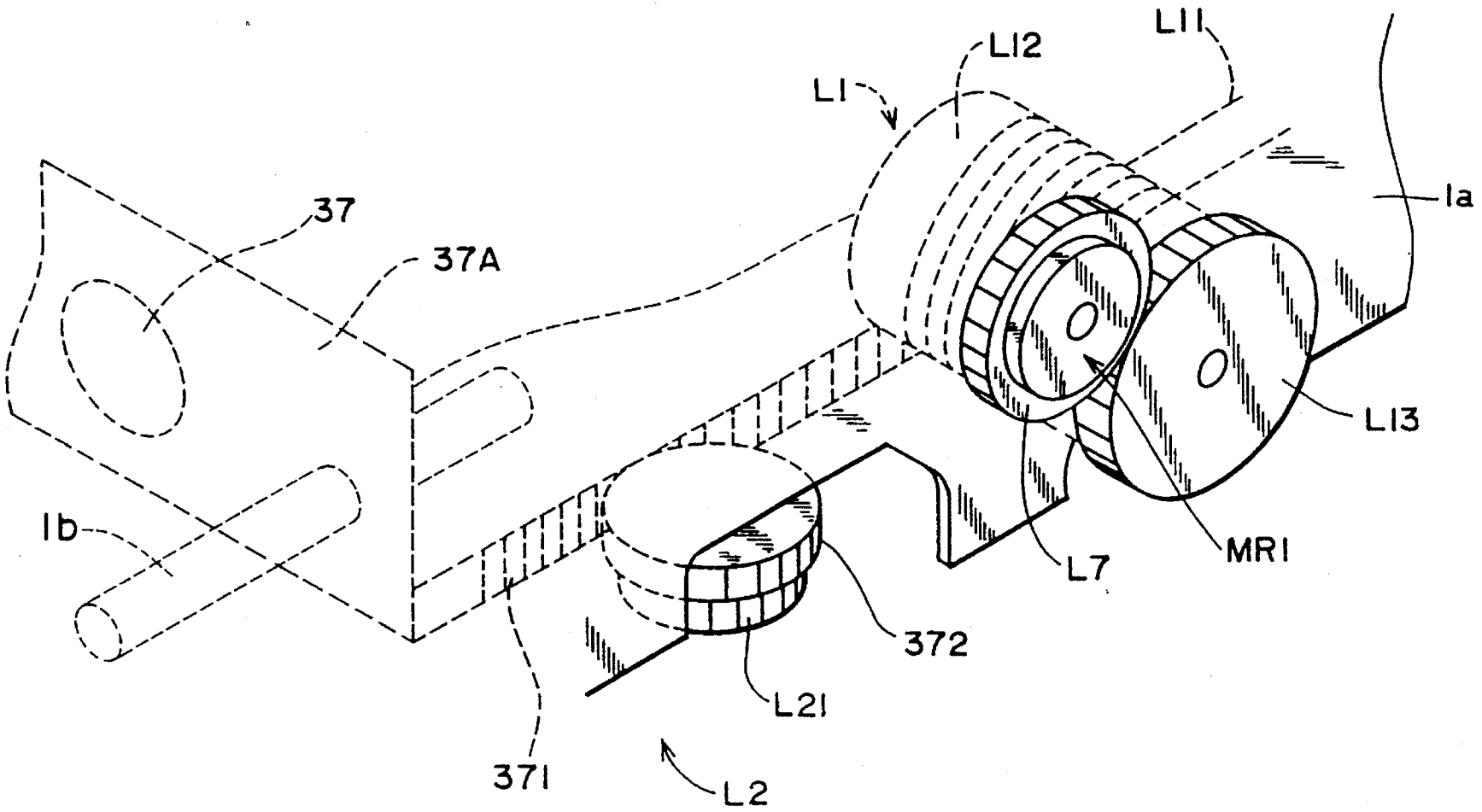
FIG. 6 is a perspective view showing essential parts of the image forming apparatus side.
Figure 7:
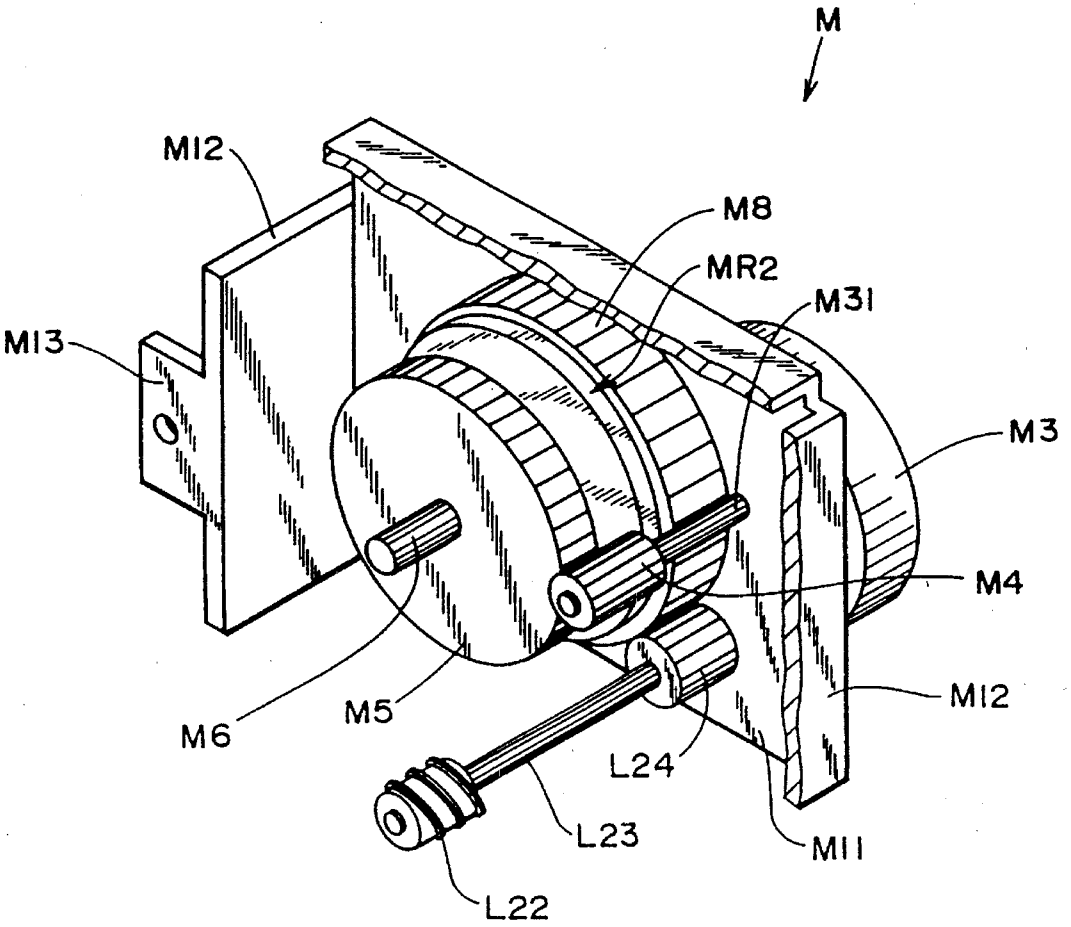
FIG. 7 is a partially cut-away perspective view showing essential parts of the torque source side.

Referring to FIG. 6, the scanning mechanism L1 is to drive reciprocally the first and second moving frames 3A and 3B in order to illuminate and scan the original, and in the embodiment, it is a conventional component constituted by extending a driving wire L11. The driving wire L11 is wound around a tubular body L12 supported rotatably on the side wall of the optical frame 1*a*, and it is constituted so that the driving force may be transmitted to the both moving frames 3A and 3B in specific direction and at specific moving speed by the rotation of the tubular body L12. The tubular body L12 is composed integrally with the transmission gear L13 disposed at the outside of the side wall of the optical frame 1*a*, and it is engaged with the scanning side input gear M7 through this transmission gear L13.

Referring back to FIG. 4 and FIG. 5, between the output gear M5 and gear cover M1, a magnification varying side input gear M8 is disposed as a magnification varying side input member for transmitting the torque to the magnification varying mechanism L2 coupled with the lens unit 37A. The magnification varying side input gear M8 integrally comprises an annular boss M81 penetrating almost concentrically at the other end side of the sliding shaft M6 in assembling, and is rotatably supported on the back plate M11 in a state of penetrating the back plate M11 of the gear cover M1 through a bearing M82 supporting the boss M81. On the side confronting the output gear M5 of the frame side input gear M8, a urethane elastic lining MR2 is glued. The elastic lining MR2 is to transmit the torque from the output gear M5 to the frame side input gear M8 when driving by varying the magnification factor as mentioned below.

The magnification varying mechanism L2 is to change the magnification factor of the image to be formed with respect to the original, by reciprocally driving the lens unit 37A and fourth mirror 34, and in the embodiment it is realized by the link mechanism 375 and multiple gears.

Describing in detail by reference to FIG. 4 through FIG. 7, this magnification varying mechanism L2 comprises a worm wheel L21 rotatably supported on the bottom plate of the optical frame 1*a*, a worm gear L22 to be engaged with the worm wheel L21, a rotary shaft L23 of the worm gear L22, and a power transmission gear L24 fixed on the rotary shaft L23, and the power transmission gear L24 is engaged with the frame side input gear M8. The pinion gear 372 is mounted concentrically on the worm wheel L21 in a uniformly rotatable state, and the rack gear 371 is engaged with the pinion gear 372.

The other end of the sliding shaft M6 is coupled with a solenoid rod M10 as coupling driving means to be coupled and driven for alternatively connecting the output gear M5 with either input gear M7 (M8) by driving the output gear M5 through a link M9. The link M9 has a link arm M92 of an approximately L-shape supported on the fulcrum of a protruding piece M93 raised from the back plate M11 of the gear cover M1 through a support shaft M91, and one end of the link arm M92 is coupled with the other end of the sliding shaft M6 through a support shaft M94, and the other end of the link arm M92 is coupled to the end of the solenoid rod M10 through a support shaft M95, thereby transmitting the driving force of the solenoid rod M10 to the sliding shaft M6.

Figure 4:
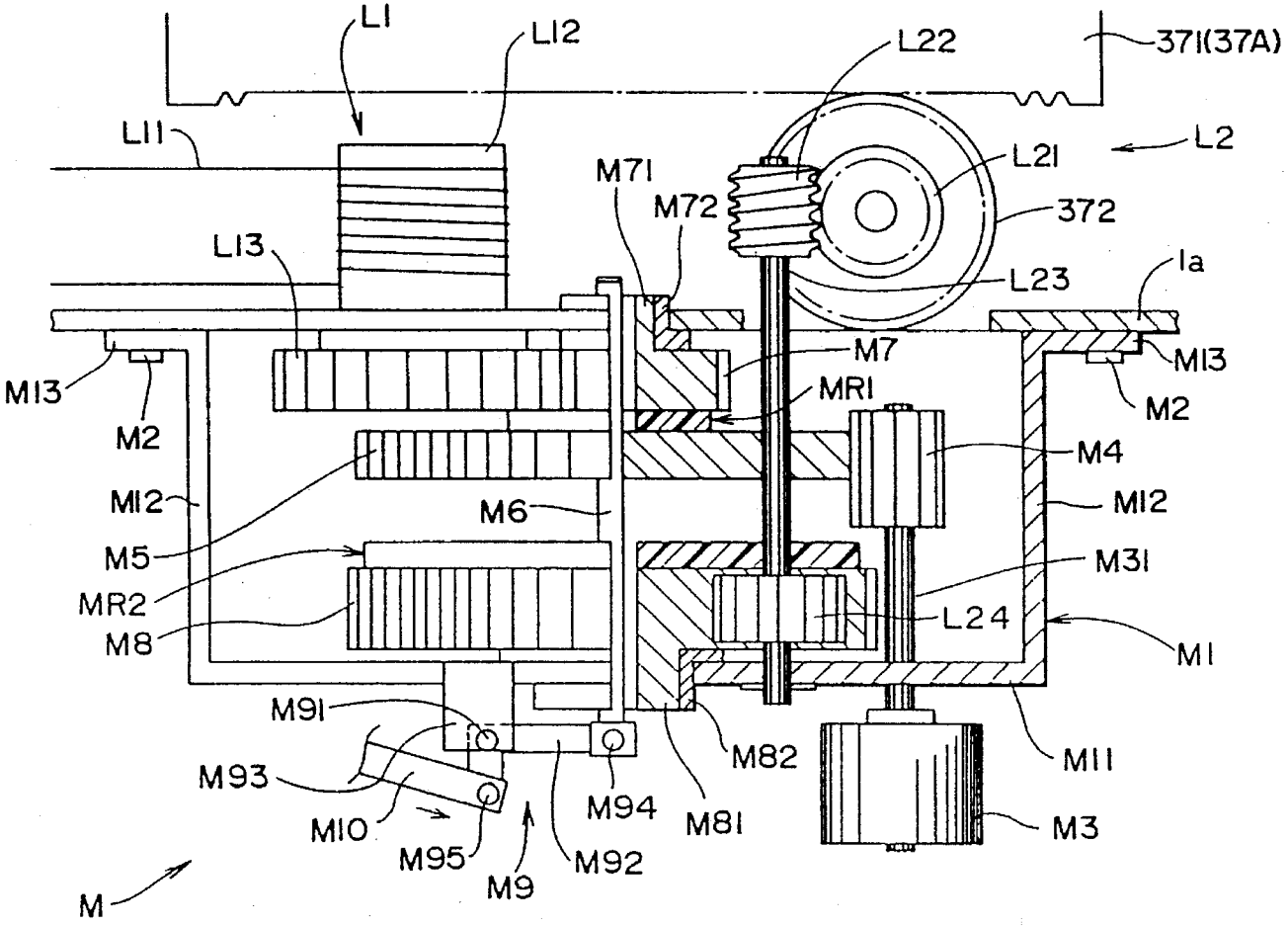
FIG. 4 is a bottom outline showing a partially cut-away view of a torque transmission mechanism of the optical system in an embodiment of the invention.
Figure 5:
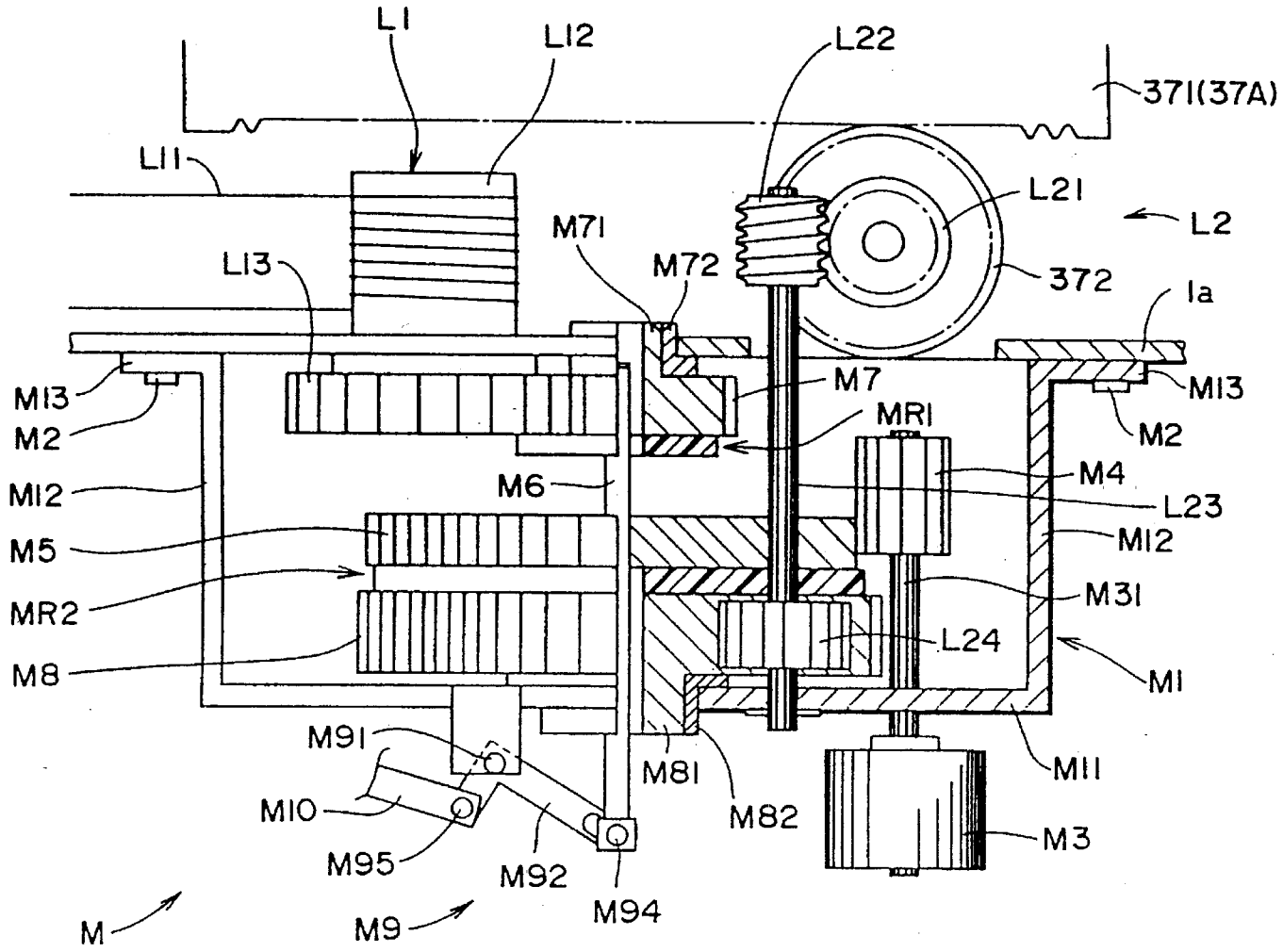
FIG. 5 is a bottom outline showing a partially cut-away view of a torque transmission mechanism of the optical system in the embodiment.

The solenoid rod M10 drives the link arm M92 counterclockwise in FIG. 4 around the support shaft M91 in the extending state shown in FIG. 4, and in the evading state shown in FIG. 5 the link arm M92 is driven clockwise in FIG. 5 around the support shaft M91. As a result, as shown in FIG. 4, when the solenoid is extended M10, the link arm M92 is driven counterclockwise in FIG. 4 around the support shaft M91, so that the sliding shaft M6 is driven to the upper side in FIG. 4, and the output gear M5 is coupled and driven to the scanning side input gear M7. On the other hand, as shown in FIG. 5, when the solenoid retreats M10, the link arm M92 is driven clockwise in FIG. 5 around the support shaft 91, and the sliding shaft M6 is driven to the lower side in FIG. 5, so that the output gear M5 is coupled and driven to the frame side input gear M8.

According to the torque transmission mechanism M of the optical system of the embodiment composed in this way, when illuminating and scanning the original, as the solenoid rod M10 couples and drives the output gear M5 to the scanning side input gear M7, as shown in FIG. 4, the output gear M5 is pushed to the elastic lining MR1 glued to the scanning side input gear M7 by the driving force of solenoid rod M10. As a result, the torque of the motor M3 is transmitted only to the scanning side input gear M7 through the elastic lining MR1 from the power transmission gear M4 and output gear M5, and therefore the transmission gear L13 engaged with the scanning side input gear M7 is rotated and driven in the specified direction, and the tubular body L12 integrally formed with the transmission gear L13 is rotated and driven, so that the first and second moving frames 3A and 3B may be driven in a specific direction through the driving wire L11 of the scanning mechanism L1 wound on the tubular body L12.

On the other hand, in driving by varying the magnification, when the solenoid rod M10 couples and drives the output gear M5 to the frame side input gear M8, as shown in FIG. 5, the output gear M5 is pushed to an elastic lining MR2 glued to a frame side input gear M8 by the driving force of the solenoid rod M10. As a result, the rotary driving force of the motor M3 is transmitted only to the frame side input gear M8 through the elastic lining MR2 from the power transmission gear M4 and output gear M5, so that the power transmission gear L24 engaged with the frame side input gear M8 is rotated and driven in a specific direction, and by rotating and driving a worm gear L22 through a rotary shaft L23 supporting the power transmission gear L24, the rack gear 371 is driven through the worm wheel L21 and the pinion gear 372 formed integrally with the worm wheel L21, so that the lens unit 37A may be driven in a specific direction.

In this operation, since the output gear M5 is put in either input gear M7 (M8) only, and when driving the lens unit 37A for controlling the variable magnification, the first and second moving frames 3A and 3B for illumination and scanning will not follow the lens unit 37A. Therefore, according to the torque transmission mechanism M of the optical system of the embodiment, it is not necessary to return the first and second moving frames 3A and 3B to the home position after changing the magnification factor of the original image, and hence the control is simplified. Still more, since either one of the first and second moving frames 3A and 3B is driven by the motor M3, the load acting on the motor M3 is small, and by using a motor M3 of relatively small size, the entire apparatus may be reduced in size, while the cost can be lowered.

In the torque transmission mechanism M of the optical system of the embodiment, by using the elastic linings MR1 and MR2, the torque can be transmitted regardless of the relative positions of the elastic linings MR1 and MR2 and members rotating relatively to the elastic linings MR1 and MR2 (the output gear M5 in this embodiment) in the circumferential direction, so that positioning in connection is not needed, and a simple power connection mechanism may be composed.

The foregoing embodiments show only preferred examples of the invention, and the invention is not limited to the illustrated embodiments alone.

For example, the fulcrum member 375*c* may be composed of a different member (preferably a metal member) from the first and second cam arms 375*a* and 375*b*.

By the solenoid rod M10 as the coupling driving means, it may be constituted to drive the input gears M7 and M8 alternatively to the output gear M5.

Moreover, the elastic linings MR1 and MR2 may be glued to both sides of the output gear M5.

In addition, it may be easy to understand for those skilled in the art that the link mechanism as the first power transmission mechanism may be applied in an image forming apparatus of original platen moving type for illuminating and scanning by moving the original platen. Likewise, the torque transmission mechanism as the second power transmission mechanism may be applied in the image forming apparatus of the original platen moving type. In this case, those skilled in the art may apply the invention by replacing the scanning mechanism L1 by the original reciprocal moving mechanism.

The embodiments herein are mere examples used for clarifying the technical detail of the invention, and the invention should not be interpreted in a narrow sense of meaning by limiting to these examples alone. Hence, the spirit and scope of the invention should be limited only by the description of the appended claims.

We claim:

1. A power transmission mechanism for interlocking a moving member for adjusting an optical path length in response to displacement of a lens unit, when changing a magnification factor of an original image in an image forming apparatus, comprising:

output means integrally formed with the lens unit for delivering a driving force in response to displacement of the lens unit, and a cam member including a first cam arm coupled to the output means, and a second cam arm integrally formed with the first cam arm and coupled to the moving member, said cam member being for changing the moving extent of the lens unit by the lever ratio of the first and second cam arms, whereby transmitting the drive force to the moving member.

2. A power transmission mechanism of claim 1, wherein the cam member is formed in an L-shape in which the first and second cam arms extend in mutually approximately orthogonal positions.

3. A power transmission mechanism of claim 2, wherein the cam arms have basal portions, and the cam member includes a fulcrum member for pivoting the basal portions of the cam arms.

4. A power transmission mechanism of claim 1, wherein the output means is a cam surface formed integrally with the lens unit, and the cam surface being smoothly sinking in a direction approximately orthogonal to a direction in which the lens unit is displaced.

5. A power transmission mechanism of claim 4, wherein the cam surface is formed on a rack gear integrally formed on the lens unit.

6. A power transmission mechanism of claim 5, wherein the rack gear is engaged with a pinion gear driven by a driving source through a torque transmission mechanism.

7. A power transmission mechanism of claim 6, wherein the torque transmission mechanism comprises: a scanning side input member for transmitting the torque to a scanning mechanism coupled to a moving member for illumination scanning; a magnification varying side input member being disposed oppositely to the scanning side input member, for transmitting the torque to a magnification varying mechanism coupled to the lens unit; an output member disposed between the both input members, for delivering the torque from a torque source; coupling driving means capable of working in order to connect the output member with one of the input members alternatively; and elastic linings disposed between confronting surfaces of the output member and the input members, for transmitting the torque from the output member to the input member.

8. A power transmission mechanism of claim 1, wherein the image forming apparatus illuminates and scans by moving a light source.

9. A power transmission mechanism of claim 1, wherein the moving member is a moving frame for holding a reflector plate of optical system.

10. A power transmission mechanism of claim 1, wherein the moving member is biased by an elastic member in a direction to be pressed against the second cam arm.

11. A power transmission mechanism comprising:

a scanning side input member for transmitting torque to a scanning mechanism coupled to a moving member for illumination scanning, a magnification varying side input member being disposed oppositely to the scanning side input member, for transmitting the torque to a magnification varying mechanism coupled to a lens unit, an output member disposed between the two input members, for delivering a torque from a torque source, coupling driving means capable of working in order to connect the output member with one of the input members alternatively, and elastic linings disposed between the confronting surfaces of the output member and the input members, for transmitting the torque from the output member to an input member connected thereto.

12. A power transmission mechanism of claim 11, wherein the scanning side input member is mounted on a side wall of an optical frame of the image forming apparatus.

13. A power transmission mechanism of claim 11, wherein the scanning side input member drives a driving wire through a transmission member.

14. A power transmission mechanism of claim 11, wherein the scanning side input member is a scanning side input gear disposed concentrically with the elastic linings.

15. A power transmission mechanism of claim 14, wherein the transmission member comprises a transmission gear to be engaged with a scanning side input gear and a tubular body rotated and driven together with the transmission gear as one body.

16. A power transmission mechanism of claim 11, wherein the magnification varying side input member is mounted on a gear cover fastened to a side wall of an optical frame of an image forming apparatus.

17. A power transmission mechanism of claim 16, wherein the magnification varying side input member drives the magnification varying mechanism through a coupling member.

18. A power transmission mechanism of claim 17, wherein the magnification varying side input member is a magnification varying side input gear disposed concentrically with the elastic linings.

19. A power transmission mechanism of claim 18, wherein the coupling member comprises a power transmission gear to be engaged with the magnification varying side input gear, a rotary shaft supporting the power transmission gear, a worm gear rotating together with the rotary shaft, a worm wheel to be engaged with worm gear, a pinion gear formed together with the worm wheel, and a rack gear to be engaged with the pinion gear.

20. A power transmission mechanism of claim 11, wherein the output member is accommodated in a gear cover fastened to a side wall of an optical frame of an image forming apparatus.

21. A power transmission mechanism of claim 20, wherein the output member is an output gear disposed concentrically with the elastic linings.

22. A power transmission mechanism of claim 21, wherein the output gear is coupled to a rotary driving source through the power transmission gear.

23. A power transmission mechanism of claim 11, wherein the coupling driving means comprises a link, and a solenoid valve for alternatively moving the output member through the link.

24. A power transmission mechanism of claim 23, wherein the link comprises a support shaft, and an approximately L-shaped link arm supported pivotally on a gear cover through the support shaft.

25. A power transmission mechanism of claim 24, wherein the link arm is coupled with a sliding member for relatively rotatably supporting the output member, and the sliding member slides the output member along an axial line of the scanning side and magnification varying side input members which are concentrically disposed on the output member.

26. A power transmission mechanism of claim 11, in combination with an image forming apparatus illuminates and scans by moving a light source.

27. A power transmission mechanism of claim 11, wherein the moving member is a moving frame for supporting a reflector plate of an optical system.

* * * * *